US007384248B2

(12) United States Patent
Jansen

(10) Patent No.: US 7,384,248 B2
(45) Date of Patent: Jun. 10, 2008

(54) FUEL METERING PUMP

(75) Inventor: Harvey B. Jansen, Mesa, AZ (US)

(73) Assignee: Jansen's Aircraft Systems Controls, Inc., Tempe, AZ (US)

( * ) Notice: Subject to any disclaimer, the term of this patent is extended or adjusted under 35 U.S.C. 154(b) by 506 days.

(21) Appl. No.: 10/891,269

(22) Filed: Jul. 14, 2004

(65) Prior Publication Data

US 2005/0013706 A1 Jan. 20, 2005

Related U.S. Application Data

(60) Provisional application No. 60/487,175, filed on Jul. 14, 2003, provisional application No. 60/580,177, filed on Jun. 16, 2004.

(51) Int. Cl.
*F04B 17/00* (2006.01)

(52) U.S. Cl. ..... 417/413.1; 417/269

(58) Field of Classification Search ..... 417/269, 417/413.1, 534–537; 91/501, 502, 499; 123/56.2, 123/56.3, 56.6, 56.9; 74/23–25, 60; 92/71
See application file for complete search history.

(56) References Cited

U.S. PATENT DOCUMENTS 1,229,009 A 6/1917 Allison
2,070,880 A 2/1937 Blum
5,366,642 A * 11/1994 Platter et al. ..... 210/767
5,704,274 A 1/1998 Forster
5,918,529 A 7/1999 Forster
5,941,693 A 8/1999 Kato
6,371,740 B1 * 4/2002 Jansen ..... 417/413.1

* cited by examiner

*Primary Examiner*—Devon C. Kramer
*Assistant Examiner*—Vikansha Dwivedi
(74) *Attorney, Agent, or Firm*—Quarles & Brady LLP

(57) ABSTRACT

A fuel metering pump provides a compact and reliable fuel delivery system meeting the stringent contamination resistance, accuracy, pressure and flow requirements of jet engine combustion. The metering pump has a motor driven dual face cam drive arrangement that reciprocates a pair of double-acting spool pistons to both pump and meter fuel to the engine. The motor rotates the cam shaft mounted face cams, which have oppositely clocked ramps on which rollers ride to transfer the rotation forces from the face cam to reciprocate the pistons. The double-acting pistons each provide both compression and suction on each stroke. The tandem face cams arranged at opposite sides of the cam followers provides consistent and precise metering with minimal pulsation. Low pressure drop at the inlets allows the metering pump to operate very near true vapor pressure without risk of cavitation or the need for a boosted inlet.

25 Claims, 8 Drawing Sheets

FUEL METERING PUMP

CROSS-REFERENCE TO RELATED APPLICATION

This application claims benefit to U.S. provisional application Ser. No. 60/487,175 filed Jul. 14, 2003 and 60/580,177 filed Jun. 16, 2004.

STATEMENT OF FEDERALLY SPONSORED RESEARCH OR DEVELOPMENT

Not applicable.

BACKGROUND OF THE INVENTION

1. Technical Field

The present invention relates to fuel delivery systems for stationary and propulsion gas turbine engines, and in particular to fuel pumping and metering devices for turbine engines.

2. Description of the Related Art

The high burn rates of gas turbine engines requires the fuel delivery system to be capable of rapidly and precisely metering fuel. Traditionally, fuel delivery systems for turbine engines, particularly those used for jet propulsion, have included a fuel pump, a pressure accumulator and a fuel metering device, all of which are separate components mounted on or near the engine and coupled to the engine and fuel source by suitable fuel lines. The accumulator operates to dampen pulsation or ripple in the fuel caused by the pump so that the metering device can accurately dispense the appropriate amount of fuel to the engine fuel atomizer. The use of multiple components is expensive and occupies space, which is especially limited for propulsion systems.

It is desirable to reduce the number of components in the fuel delivery by combining the fuel pump and metering device into one unit. However, such combined device must meet both the extreme pump and the metering requirements for turbine engines. Some of the attributes of a turbine engine fuel pump include the ability to pump particle contaminated fuel for an extended time period. It must have good dry lift capability and be able to operate with high vapor-to-liquid ratios at the pump inlet. Moreover, if no accumulator or fluid muffler is to be used, the pump must also be able to provide generally non-pulsating fuel flow. The requirements of a turbine engine metering device, particularly those used for jet propulsion, include low power consumption and low hysteresis to operate with high efficiency and low friction. The device must also have a high turn-down ratio to accurately meter a wide range of flow rates. Additionally, the device must be compact and have minimal internal leakage.

In the turbine industry, the fuel delivery systems typically employ gear pumps which create a pressure differential by moving the fuel through a series of intermeshing teeth running at a high frequency. Gear pumps consume a lot of power and leak internally and are therefore less than ideal for jet engine use. Moreover, due to reliability concerns, gear pumps used for propulsion applications typically are powered by an engine driven gear box (rather than an electric motor) and therefore must be coupled to a separate metering valve via suitable fuel lines, which increases expense and occupies additional space.

U.S. Pat. No. 6,371,740, assigned to the assignee of the present invention and hereby incorporated as though fully set forth herein, discloses a fuel metering pump for turbine engines. The metering pump employs a rotating face cam to alternately reciprocate a pair of actuators that in turn drive a pair of rolling diaphragms to pump and meter the fuel. The metering pump is specially designed to drive the pumping members at a constant velocity to minimize pressure ripple and thus provide essentially non-pulsed metering of the fuel. The rolling diaphragm design assists in keeping contaminants commonly found in jet fuel from degrading the working components of the metering pump.

While the aforesaid metering pump provides a marked improvement in accurate fuel metering at the high flow rates required for jet engines, the diaphragms have pressure limitations that can make the metering pump unsuitable for high pressure applications like jet engines. In particular, it can be necessary in some jet engine applications to achieve a pressure rise of over 500 psi. This pressure must be generated and maintained will metering the high flow rates required for sustained combustion, which can be 700 pph or more.

Accordingly, a high pressure metering pump is needed that can efficiently and accurately meter fuel at the high flow rates required for jet engines

SUMMARY OF THE INVENTION

The present invention provides a compact, yet highly accurate combined metering and pumping device for fuel delivery in gas turbines, particularly jet engines. The metering pump employs a motor driven face cam arrangement to drive a pair of pistons that pump and meter the fuel. The device provides high pressure and flow rates of non-pulsed liquid, while exhibiting very low leakage and having good dry lift and turn-down capabilities.

In one aspect the invention provides a fuel metering pump having an inlet for coupling to a fuel supply and an outlet for coupling to a fuel consuming device. The metering pump includes a rotatable face cam arrangement having a pair of opposing axially spaced, 180 degree out of phase ramps, which have different axial dimension at different angular positions of the face cam arrangement. A pair of cam followers move in response to the ramps as the face cam arrangement is rotated to reciprocate a pair of pistons along parallel piston axes to control flow between the inlet and outlet.

In another aspect the invention provides a fuel metering pump having a pump body with an inlet for coupling to a fuel supply and an outlet for coupling to a fuel consuming device. The pump body defines first and second piston chambers disposed along respective first and second parallel piston axes. First and second spool pistons are disposed in the associated piston chambers for reciprocation along the associated piston axes. A face cam, rotatable within the pump body, has a ramp of differing axial dimension at different angular positions of the face cam. First and second cam followers are linked to the associated pistons engaging the ramp to move the pistons along the respective piston axes in response to rotation of the face cam to control flow between the inlet and outlet.

The face cam arrangement preferably includes two face cams, each face cam defining a ramp. The face cam arrangement can be a monolithic structure, or one or both of the face cams can be separate components mounted onto a cam shaft. Preferably, the cam shaft is bearing mounted and driven by a DC motor. The cam followers extend in a direction at an angle, preferably perpendicular, to the piston axes. Rollers on the cam followers ride simultaneously on both of the ramps as the cam shaft is rotated. The cam followers are fixed to the pistons and have slider ends that ride in guide channels of the housing to impart axial movement to the pistons. The ramps extend axially in a continuous circular path at the face of the face cams. Each ramp has a 180 degree incline and a 180 degree decline. The ramps are 180 degrees out of phase so that the beginning of the incline of one ramp is the beginning of the decline of the other ramp. This allows the cam follower rollers to ride simultaneously on both ramps, and thereby move axially in response to axial forces imparted from the rotating ramps on opposite axial sides of the cam followers. The application of opposite tandem or counterpart pushing forces provide highly accurate and reliable axial positioning of the cam followers, and in turn movement of the pistons, and thereby metering of the fuel.

The pistons are preferably double acting spool type pistons, each controlling flow through two sets of inlet an outlet ports. The spools preferably have one or more circumferential pressure balancing grooves allowing the pistons to slide smoothly within the piston chambers with minimal clearances, which in turn provides low internal leakage without the use of piston seals. Residual air space at top dead center is minimized to improve dry lift capability. The pistons reciprocate between a pair of valve heads mounting low pressure drop valves, such as reed valves, which allow for very low inlet pressure, in the range of 2-5 psi above true vapor pressure, without cavitation or need for a boosted inlet. Open weave type filters are used at the inlet to reduce particle contamination without excessive pressure drop.

These and still other advantages of the invention will be apparent from the detailed description and drawings. What follows is a preferred embodiment of the present invention. To assess the full scope of the invention the claims should be looked to as the preferred embodiment is not intended as the only embodiment within the scope of the invention.

DETAILED DESCRIPTION OF THE PREFERRED EMBODIMENT

Figure 1:
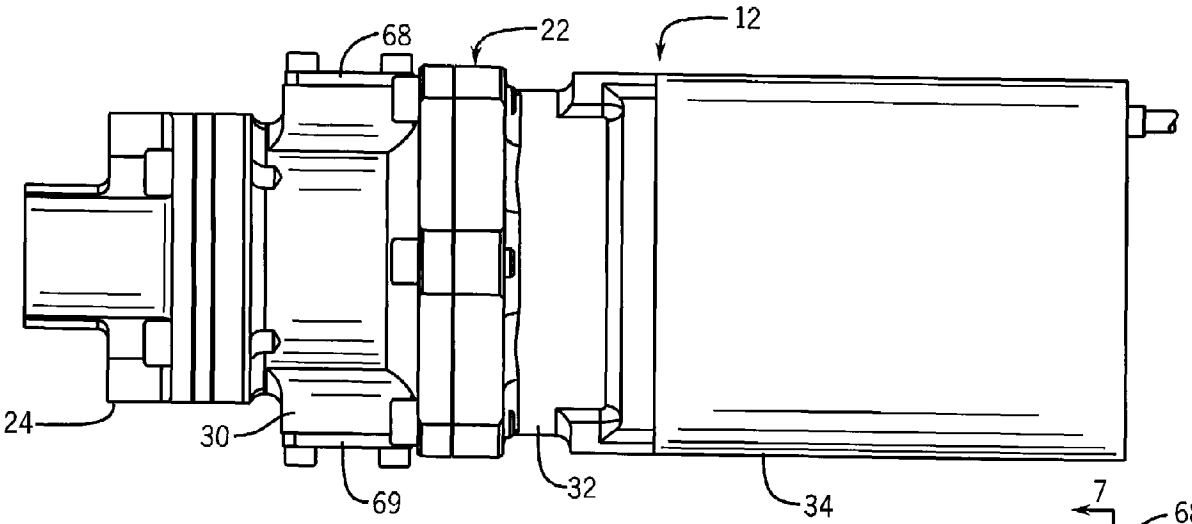
FIG. 1 is a side elevational view of a fuel metering pump according to the present invention.
Figure 2:
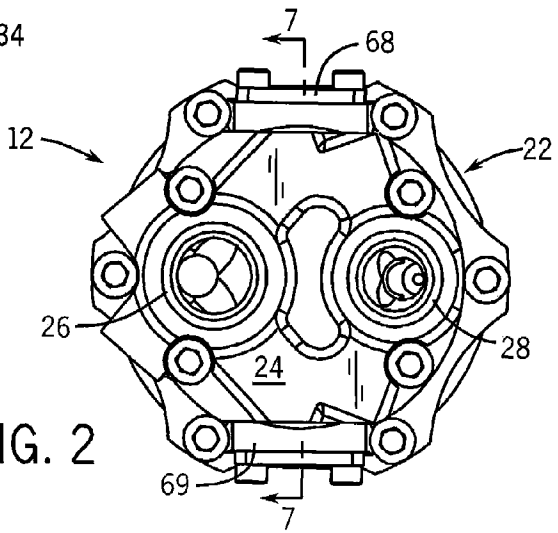
FIG. 2 is an end elevational view thereof.

The fuel metering pump of the present invention is generally referred to by number 12 in the drawings, and its exterior is shown in FIGS. 1 and 2 thereof. The metering pump 12 is preferably a motor-driven, face cam-actuated, double-acting spool piston pump capable of precisely metering non-pulsating fuel at high pressure and flow rates to the combustor of a gas turbine engine.

Figure 9:
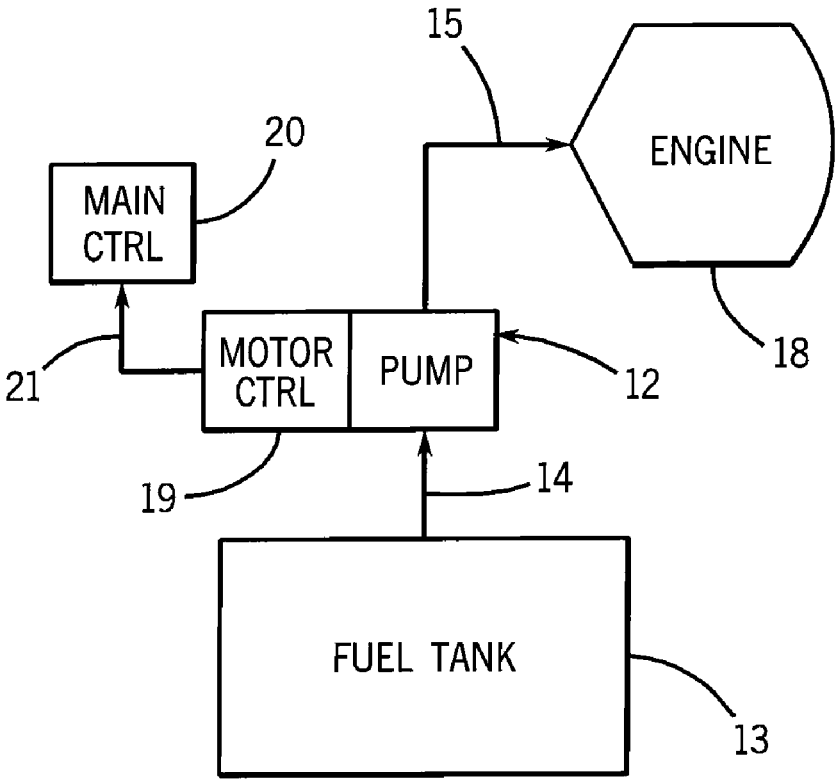
FIG. 9 is a block diagram of a gas turbine fuel delivery system incorporating the fuel metering pump.

FIG. 9 shows the fuel metering pump 12 as a part of a gas turbine engine fuel delivery system. The fuel metering pump 12 couples to an onboard fuel tank 13 via inlet fuel line 14 to pump combustible fuel contained therein through an outlet fuel line 15 to a gas turbine engine 18 (or an auxiliary power unit thereof). The gas turbine engine 18 is preferably any suitable jet engine used for stationary (or land-based vehicular) and propulsion applications. The metering pump 12 is controlled by a motor controller 19 coupled to an onboard master controller 20 communicating over a two-way bus 21.

Figure 3:
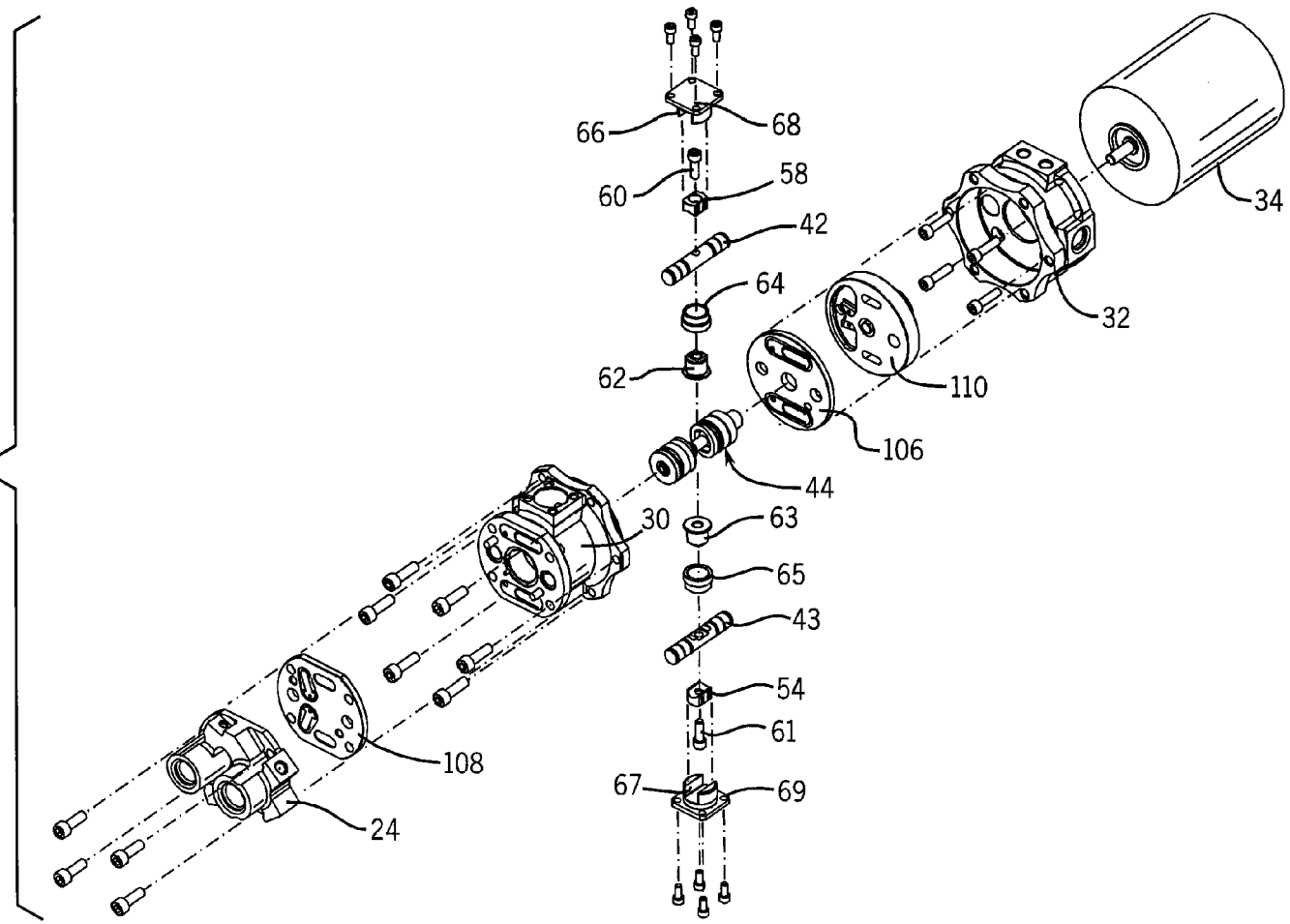
FIG. 3 is an exploded assembly view thereof.
Figure 4:
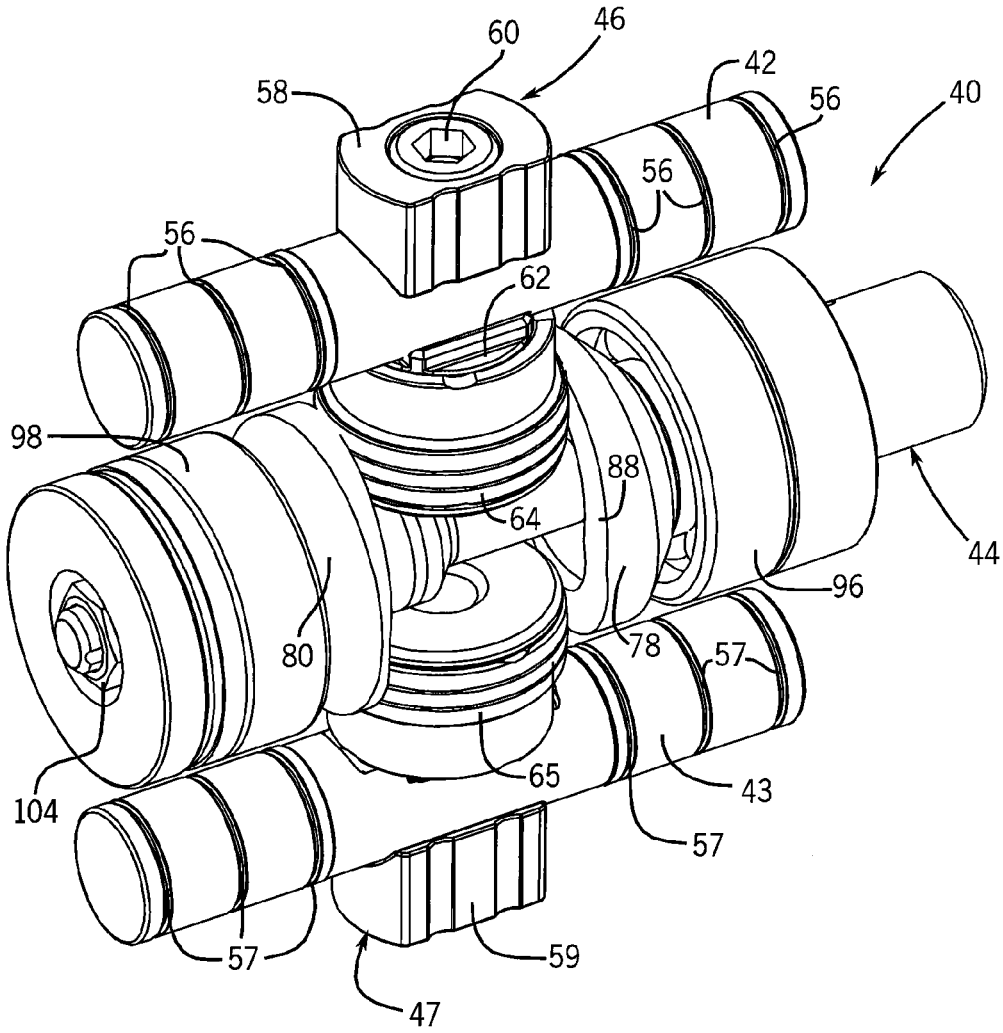
FIG. 4 is an assembly view of an actuator and piston assembly.
Figure 5:
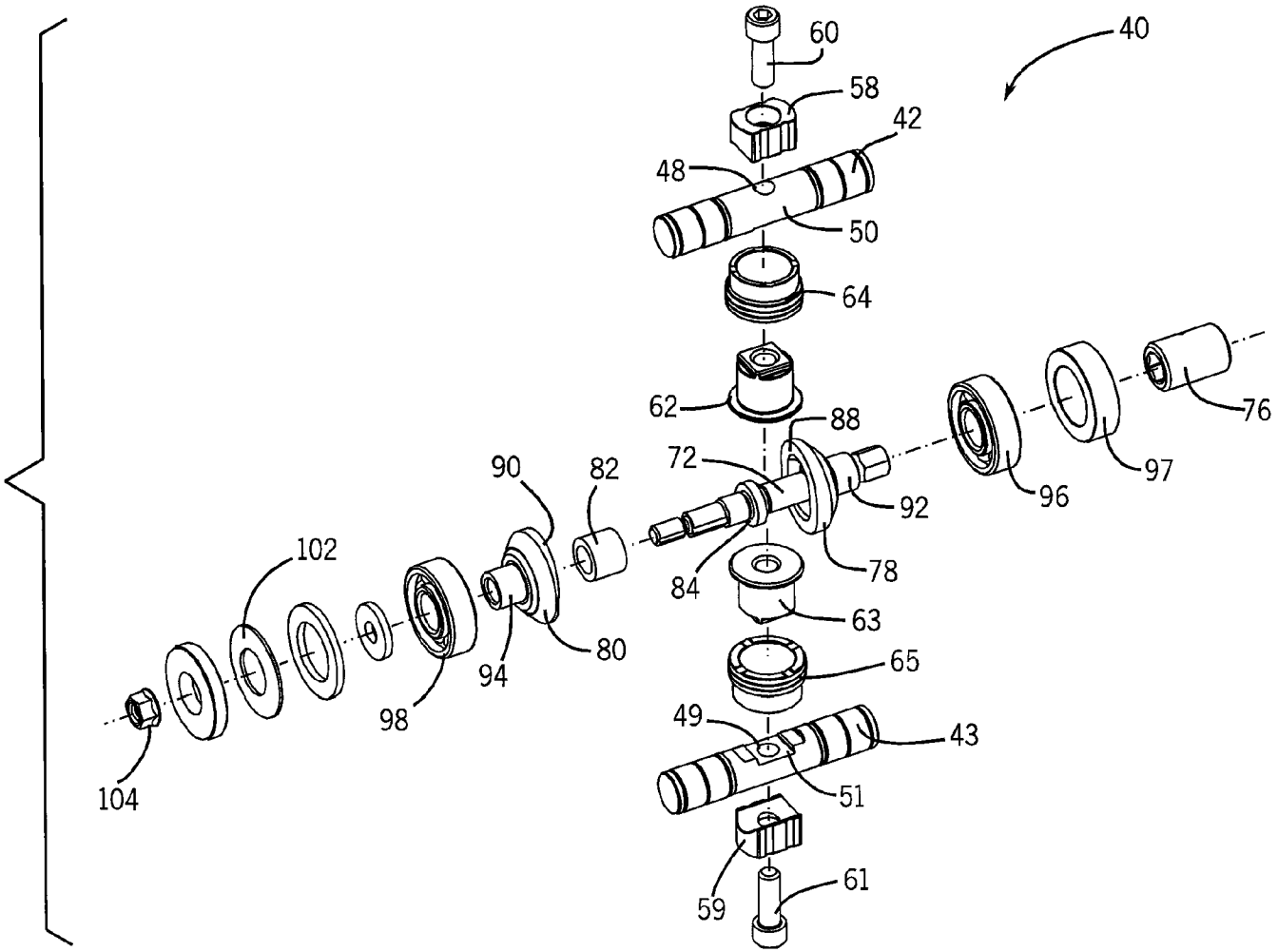
FIG. 5 is an exploded assembly view thereof.
Figure 7:
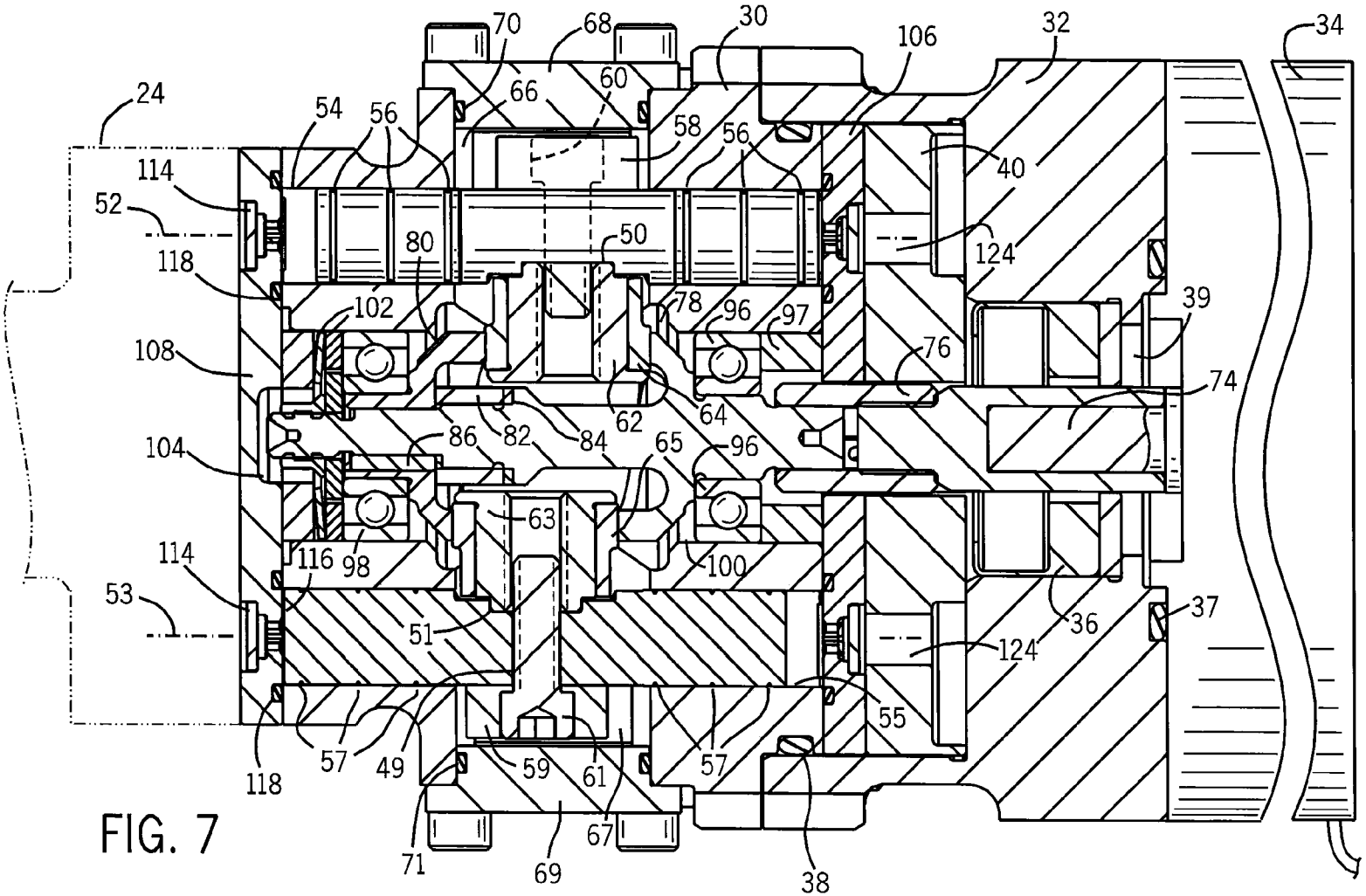
FIG. 7 is a partial cross-sectional view taken along line 7-7 of FIG. 2, showing the internal components of the metering pump.

Referring to FIGS. 1-3, the metering pump 12 has a compact housing 22 including a head section 24 with primary inlet 26 and outlet 28 ports (suitably coupled to inlet 14 and outlet 15 fuel lines shown in FIG. 9), a pump housing 30, and an adapter 32 to a motor drive and control unit 34. The metering pump 12 is preferably mounted to a supporting structure at the adapter 32, which is at near its center of gravity, to minimize structural distortion caused by vibration and shock loading, which can effect the tight clearances between the pumping components. The motor drive and control unit 34 bolts onto the adapter 32, and the adapter bolts together with the other housing sections, which are preferably made of a light weight, yet strong material, such as a suitable aluminum alloy. Referring briefly to FIG. 7, a shaft seal 36 and face seal 37 seal off the adapter 32 and motor/control unit 34 interface. Seal 38 seals the interface between the adapter 32 and the pump housing 30. An interstitial vent passageway 39 behind the shaft seal 36 leads to an external witness drain to allow regular monitoring of shaft seal performance.

Referring to FIGS. 4-5 and 7-8, the pump housing 30 houses an actuator and piston assembly 40. This assembly includes a pair of pistons 42 and 43, a face cam assembly 44, and a pair of cam follower assemblies 46 and 47. The pistons 42 and 43 are double-acting pistons having flat heads at each end of an elongated cylindrical spool body through the middle of which are transverse holes 48 and 49 intersecting squared recesses 50 and 51. The pistons 42 and 43 reciprocate along piston axes 52 and 53 within piston chambers 54 and 55 of the pump housing 30 (see FIG. 7). Since the pistons 42 and 43 are double-acting, both ends of the pistons are creating pressure, one end being in a pump stroke while the other is in a suction stroke.

The pistons 42 and 43 do not have piston rings or seals because of the high pressure and rapid stroke required for turbine engines would generate high friction and in turn wear the rings, which would require frequent maintenance and/or replacement of the rings. To avoid using piston rings, close clearances are required between the pistons 42 and 43 and the piston chambers 54 and 55 to achieve compression and suction during operation. The closer the clearance, the better the pumping action. When no piston rings are present to create a sliding seal, some amount of fuel can leak into the small clearance space around the pistons. If this fuel contains contaminants, the small particles can build up and/or become lodged in the small space between the piston and its chamber. And, since there are no piston rings to center the pistons, the pistons can be moved off of their axes and pushed against the walls of the chambers. This binding can reduce efficiency and even destroy the operation of the pump.

To prevent this, the pistons 42 and 43 have a series of spaced apart circumferential grooves 56 and 57. Preferably, there are three such grooves spaced apart at each end of each piston. The grooves 56 and 57 are preferably slightly larger in width and depth as the clearance of the pistons in the chambers. Small particle contaminants can thus be taken up in the grooves so that they do not interfere with the movement of the pistons. In this way, these grooves act to pressure balance the pistons and allow them to slide along the piston axes without binding.

The pistons 42 and 43 are moved by the cam follower assemblies 46 and 47. These assemblies include sliders 58 and 59 mounted by cap screws 60 and 61 that extend through the transverse holes 48 and 49 in the pistons 42 and 43 and thread into journals 62 and 63 to couple the cam follower assemblies 46 and 47 to the pistons 42 and 43. The journals 62 and 63 have outer raceways for rollers 64 and 65 that are rotatably captured between the pistons and end flanges of the journals 62 and 63. Squared ends of the journals 62 and 63 fit into the recesses 50 and 51 in the pistons to prevent their rotation. The cam follower assemblies 46 and 47 thus extend, essentially perpendicularly relative to the piston axes 52 and 53, to opposite sides of the face cam assembly 44, and are fixed to, and move axially with, the pistons 42 and 43. The sliders 58 and 59 ride within two guides 66 and 67 formed as inner ends of plugs 68 and 69, which are bolted to the pump housing 30 in associated openings therein and sealed by o-rings 70 and 71. The interaction of the sliders 58 and 59 in the associated guides 66 and 67 prevents the cam follower assemblies 46 and 47 from rotating as they are engaged by the face cam assembly 44.

The face cam assembly 44 includes a cam shaft 72 coupled to the shaft 74 of the motor by a hex coupler 76 having hex openings engaging the hex ends of the cam 72 and motor 74 shafts so that they rotate in unison. The cam shaft 72 has an integral face cam 78 near one end and mounts another, separate face cam 80 at the other end. The position of the mounted face cam 80 is set by sliding it onto the free end of the cam shaft 72 until it presses a spacer 82 against an annular shoulder 84 near the middle of the cam shaft 72. An anti-rotation pin or key 86 (see FIG. 7) fits in aligned keyways in the cam shaft 72 and the inner diameter of the mounted face cam 80. The face cams 78 and 80 define respective smooth, generally linear ramps 88 and 90, each being a continuous circular surface including a 180 degree incline and a 180 degree decline extending in the axial direction at the same slope and magnitude. The ramps 88 and 90 are in opposed facing relation and are spaced axially apart such that the rollers 64 and 65 of the cam follower assemblies 46 and 47 engage both ramps 88 and 90 simultaneously. The face cams 78 and 80 are clocked 180 degrees out of phase so that the beginning of the incline of ramp 88 is axially aligned with the beginning of the decline of ramp 90. Thus, as the face cams 78 and 80 are rotated, the ramps 88 and 90 will maintain the same axial spacing as they revolve through 360 degrees, and thus maintain contact with the rollers 64 and 65. And, because the cam follower assemblies 46 and 47 extend perpendicularly to the long axis of the face cam arrangement 180 degrees apart, the rollers 64 and 65 will be on opposite parts of the ramps 88 and 90 throughout the rotation of the face cams 78 and 80. Thus, the cam follower assemblies 46 and 57, and thereby the pistons 42 and 43, will move axially in opposite directions.

In operation, the motor rotates the face cam assembly which reciprocates the cam followers and in turn the pistons. The tandem push-push face cam arrangement provides consistent and accurate control of the piston movement, and thus metering of the fuel. Moreover, the dual cams provide a smooth transition between strokes and impart an essentially constant velocity motion to the pistons, at any motor speed, so as to minimize pressure ripple and provide non-pulsating fuel output well suited for high precision turbine applications. The stroke length effected by the face cam arrangement, and the length of the pistons and piston chambers, are selected so that residual air volume at top-dead-center is very small, which enhances dry-lift capability of the metering pump as well as the expulsion of entrained air.

Cylindrical sections 92 and 94 of the face cams 78 and 80 mount respective bearings 96 and 98, which have their outer races pressed into a cam chamber 100 of the pump housing 30 between the parallel piston chambers 54 and 55. The bearings 96 and 98 thus rotatably support the cam shaft 72 in the pump housing 30. Bearing 98 and the mounted face cam 80 are secured onto the cam shaft 72 by series of washers, including a Belleville type washer 102, and a nut 104 threaded onto the end of the cam shaft 72. A spacer 97 fits about the coupler 76.

Figure 8:
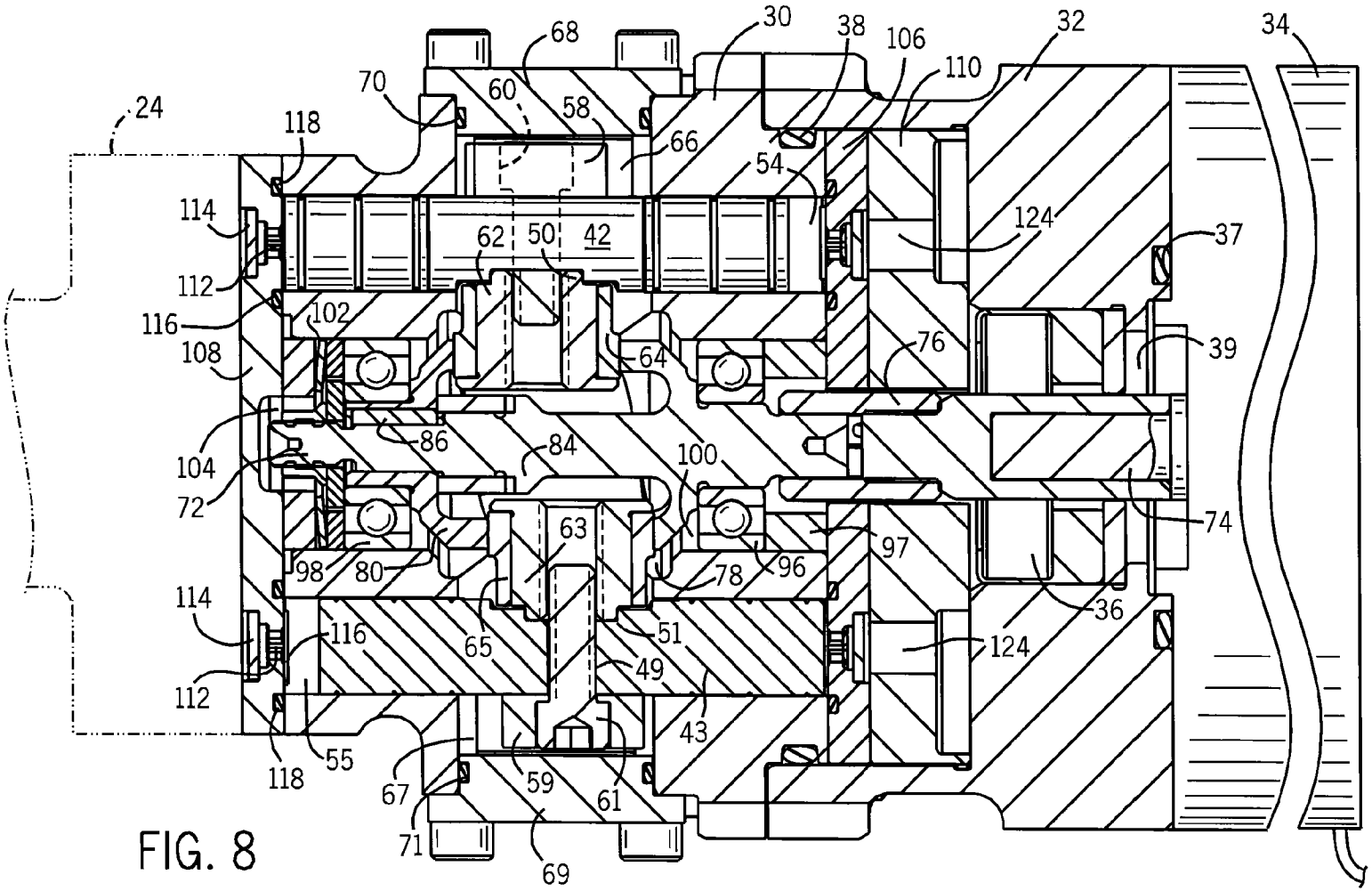
FIG. 8 is a cross-sectional view similar to FIG. 7 albeit showing the pistons in opposite positions of the pump cycle.

Referring now to FIGS. 7 and 8, as described, the actuator and piston assembly 40 is housed in the pump housing 30 with the pistons 42 and 43 disposed in the piston chambers 54 and 55 along piston axes 52 and 53 and the rotatable face cam assembly 44 disposed in chamber 100. Valve plates 106 and 108 are disposed each end of the pump housing 30, with a flow routing disk 110 being adjacent valve plate 106. Both valve heads 106 and 108 include two sets of inlets and outlets (one set for each end of each of the pistons 42 and 43) controlled by low inertia valves.

Figure 6:
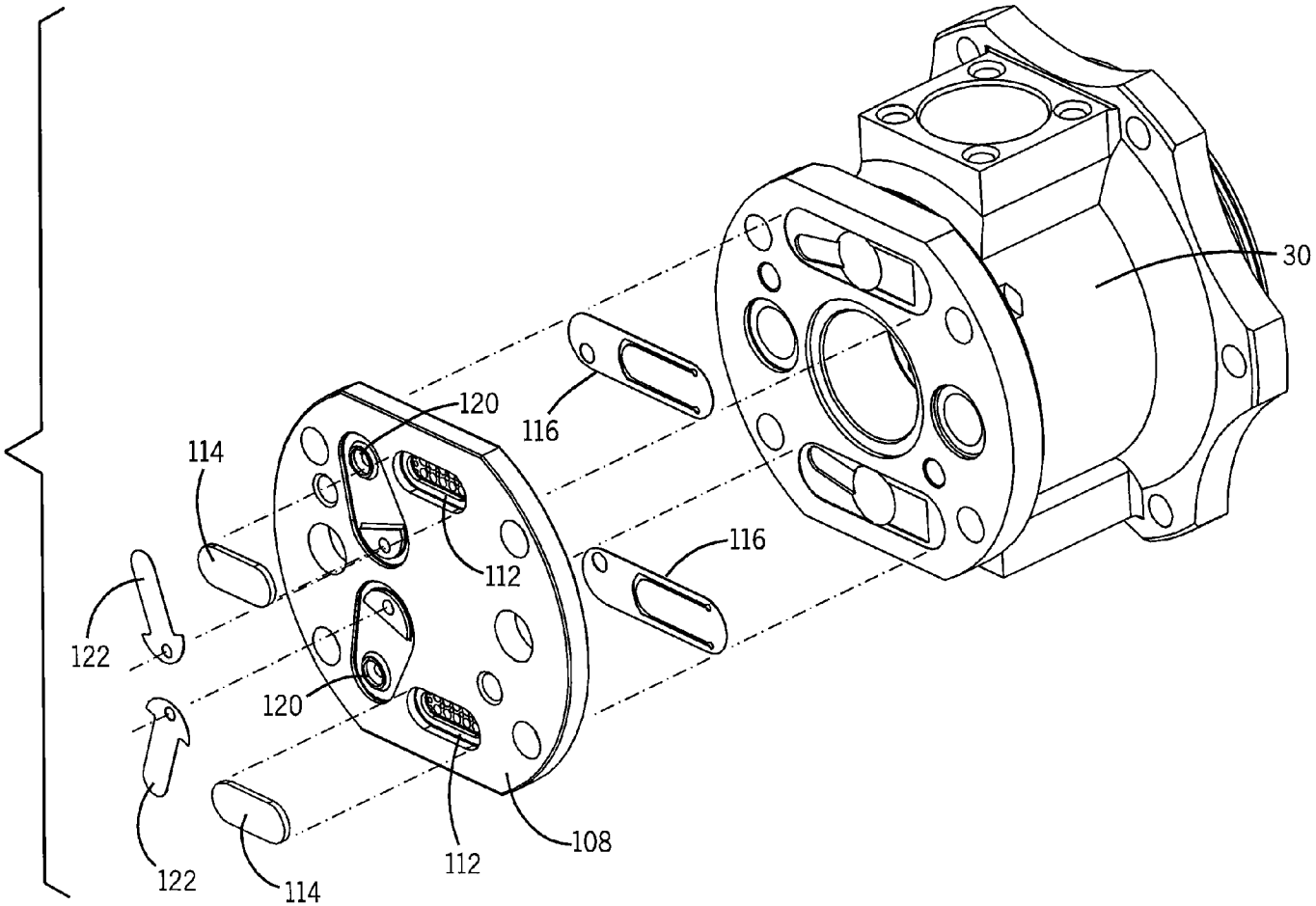
FIG. 6 is an exploded assembly view of one of the valve heads of the metering pump.

FIG. 6 illustrates the valve plate 108, which has two oblong inlet ports 112 made up of two rows of small orifices. The inlet ports 112 are recessed in the valve plate 108 so accommodate filters 114. The inlet ports 112 are controlled by oblong reed valves 116 mounted at the back side of the valve plate 108. Oblong seals 118 (see FIG. 7) fit into grooves extending around the inlet ports 112 and seal against the flanged end of the pump housing 30 about the openings for the piston chambers 54 and 55. The valve plate 108 also has outlet ports 120 controlled by reed valves 122 mounted at the front of the valve plate 108. The inlet 112 and outlet 120 ports are arranged, and the flanged end of the pump housing 30 is ported, so that a set of inlet 112 and outlet 120 ports is in communication with each of the piston chambers 54 and 55 as well as the primary inlet 26 and outlet 28 ports in the head section 24 of the housing. The valve plate 106 has a similar construction (with corresponding inlet and outlet ports, reed valves, filters and seals) albeit it interfaces with the routing disk 110, which has inlet 124 and outlet (not shown) passageways that communicate with the primary inlet 26 and outlet 28 ports at the head section 24.

The valve plate inlet ports, filters and valves are selected to achieve very low pressure drop across the inlets of the valve plates. Specifically, the plurality of small orifices at the inlet ports, in addition to making the inlets less susceptible to contamination, help break up the forces from the high speed flow that would otherwise impinge on the inlet valves. Reducing these forces allows thin, low inertia valves to be used. Less pressure is thus required to open the thin, flexible reed type valves. The filters are preferably large capacity, open weave type screen filters. These features allow the metering pump 12 to operate at inlet pressures very near true vapor pressure, preferably 2-5 psi of true vapor pressure, with minimal risk of cavitation without a boosted or pressurized inlet.

In one preferred embodiment, the metering pump 12 is approximately 2.85 inches in diameter at the pump and 3.4 inches in diameter at the motor, 11 inches in length (including ports, electronic control and electrical connectors) and weighs 7 lbs. The housing sections are anodized aluminum alloy, which contributes to its low weight. The cam shaft and valve plates are steel, and the cam follower rollers are a thin dense chrome. As mentioned, the valves are deflecting reed type valves, preferably less then 1.0 psid at 500 pph. The inlet filters are preferably open-weave screens with a micron rating of 10 nominal and 25 absolute. The motor is a three phase variable speed brushless D.C. motor consuming about 2.7 amps at 270 VDC and operating at speeds between 0 and 5000 rpm. The metering pump provides a 500 psid pressure rise without a boosted inlet and delivers a maximum of 700 pph of liquid media. The controllable flow range is approximately 30-700 pph, which correlates to a 22:1 turndown ratio.

As mentioned, the metering pump 12 is driven by the microprocessor based electronic motor controller 19 (shown diagrammatically in FIG. 9), which is integrally mounted as part of the motor drive and control unit. The motor controller 19 is electrically coupled over the network bus 21 to the master controller 20, such as an airframe computer, which provides speed input signals to the motor controller 19. The primary requirement of the motor controller 19 is to hold the angular velocity of the pump constant with minimum ripple in speed during each revolution of the motor. The motor controller 19 has position and speed sensing circuitry to monitor the rotational velocity of the motor. Motor speed is electronically monitored and compared with the commanded speed from the master controller 20. A correction is applied to the motor drive signal to maintain the commanded speed. A feed forward component consisting of speed and/or torque commands is added to the motor drive signal to rapidly move the motor to the newly commanded speed with minimal settling time.

It should be appreciated that merely a preferred embodiment of the invention has been described above. However, many modifications and variations to the preferred embodiment will be apparent to those skilled in the art, which will be within the spirit and scope of the invention. Therefore, the invention should not be limited to the described embodiment. To ascertain the full scope of the invention, the following claims should be referenced.

What is claimed is:

1. A fuel metering pump having an inlet for coupling to a fuel supply and an outlet for coupling to a fuel consuming device, the metering pump comprising;

a pair of pistons disposed along parallel piston axes;

a rotatable face cam arrangement having a pair of opposing axially spaced ramps of different axial dimension at different angular positions of the face cam arrangement, the ramps being 180 degrees out of phase; and a pair of cam followers between the ramps moved by the ramps as the face cam arrangement is rotated and linked to the pistons to reciprocate the pistons along the piston axes to control flow between the inlet and outlet.

2. The metering pump of claim 1, wherein the pistons are double acting pistons, each controlling flow through two sets of inlet an outlet ports.

3. The metering pump of claim 1, wherein the ramps each define a 180 degree incline and a 180 degree decline.

4. The metering pump of claim 1, wherein the face cam arrangement includes two face cams, each face cam defining one of the ramps.

5. The metering pump of claim 4, wherein the face cams are mounted on a cam shaft.

6. The metering pump of claim 5, wherein at least one of the face cams is a unitary part of the cam shaft.

7. The metering pump of claim 5, wherein the cam shaft is bearing mounted.

8. The metering pump of claim 1, wherein the pistons are elongated spools.

9. The metering pump of claim 1, wherein the spools have one or more circumferential pressure balancing grooves.

10. The metering pump of claim 1, wherein the cam followers extend in a direction at an angle to the piston axes.

11. The metering pump of claim 10, wherein the cam followers are fixed to the pistons to move axially therewith.

12. The metering pump of claim 11, wherein the cam followers include rollers, each roller riding simultaneously on both of the ramps.

13. The metering pump of claim 11, wherein the cam followers include sliders that move in an axial direction within guide channels.

14. The metering pump of claim 1, wherein the pistons slide in piston chambers extending between a pair of valve heads.

15. A fuel metering pump, comprising:

a pump body having an inlet for coupling to a fuel supply and an outlet for coupling to a fuel consuming device, the pump body defining first and second piston chambers disposed along respective first and second parallel piston axes;

first and second spool pistons disposed in the respective first and second piston chambers for reciprocation along the respective first and second piston axes;

a rotatable face cam arrangement having a pair of opposing axially spaced ramps of different axial dimension at different angular positions of the face cam arrangement; and first and second cam followers linked to the respective first and second pistons and engaging the ramps to move the first and second pistons along the respective first and second piston axes in response to rotation of the face cam arrangement to control flow between the inlet and outlet.

16. The metering pump of claim 15, wherein the pistons are double acting pistons, each controlling flow through two sets of inlet an outlet ports.

17. The metering pump of claim 15, wherein the ramps defines a 180 incline and a 180 degree decline.

18. The metering pump of claim 15, wherein the face cam arrangement includes two face cams, each face cam defining one of the ramps.

19. The metering pump of claim 18, wherein the face cams are mounted on a cam shaft.

20. The metering pump of claim 19, wherein at least one of the face cams is a unitary part of the cam shaft.

21. The metering pump of claim 18, wherein the cam followers include rollers, each roller riding simultaneously on both of the ramps.

22. The metering pump of claim 21, wherein the cam followers include sliders that move in an axial direction within guide channels.

23. The metering pump of claim 15, wherein the pistons have one or more circumferential pressure balancing grooves.

24. The metering pump of claim 15, wherein the cam followers extend in a direction at an angle to the piston axes.

25. The metering pump of claim 15, wherein the pistons slide in piston chambers extending between a pair of valve heads.

* * * * *